United States Patent [19]

Green

[11] 4,452,121

[45] Jun. 5, 1984

[54] SEPTACUSSION

[76] Inventor: Michael W. Green, 19191 Biltmore, Detroit, Mich. 48235

[21] Appl. No.: 385,561

[22] Filed: Jun. 7, 1982

[51] Int. Cl.[3] ..... G10D 13/02
[52] U.S. Cl. ..... 84/421
[58] Field of Search ..... 84/411, 418–421; 248/68 CB; 224/910

[56] References Cited

U.S. PATENT DOCUMENTS

| | | | |
|---|---|---|---|
| 3,437,297 | 4/1969 | Jirka et al. | 248/68 CB |
| 3,974,732 | 8/1976 | Kester | 84/421 |
| 4,126,075 | 11/1978 | Kurosaki | 84/421 |

*Primary Examiner*—Donald A. Griffin

[57] ABSTRACT

This invention comprises a percussion instrument, including seven bongo drums held together by blocks fastened therebetween, a carrying handle on one of the blocks, and a microphone holder attached to one of the drums.

3 Claims, 6 Drawing Figures

Fig. 1
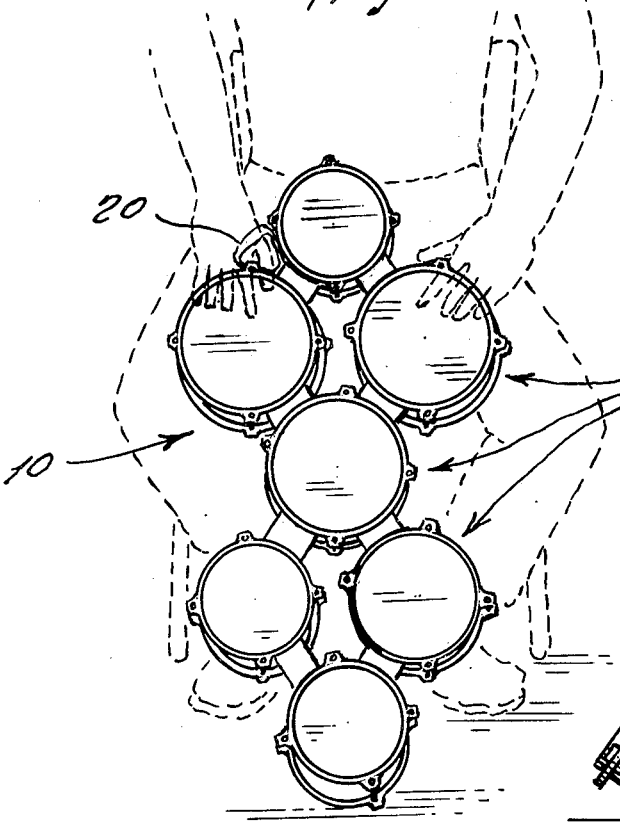
Fig. 2
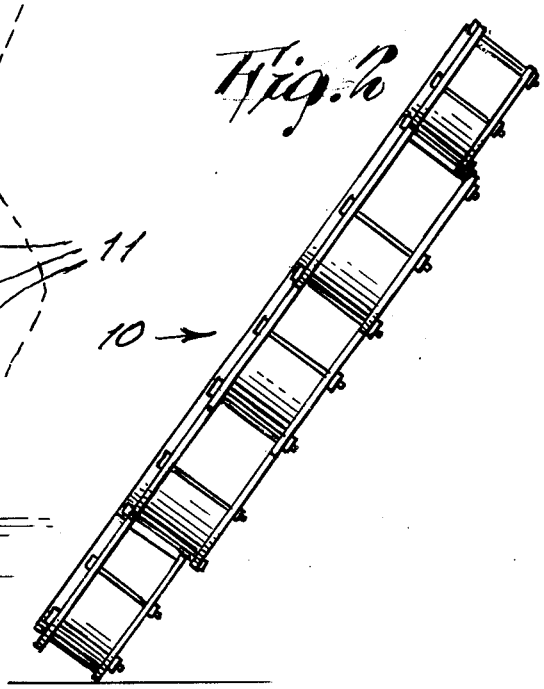
Fig. 3
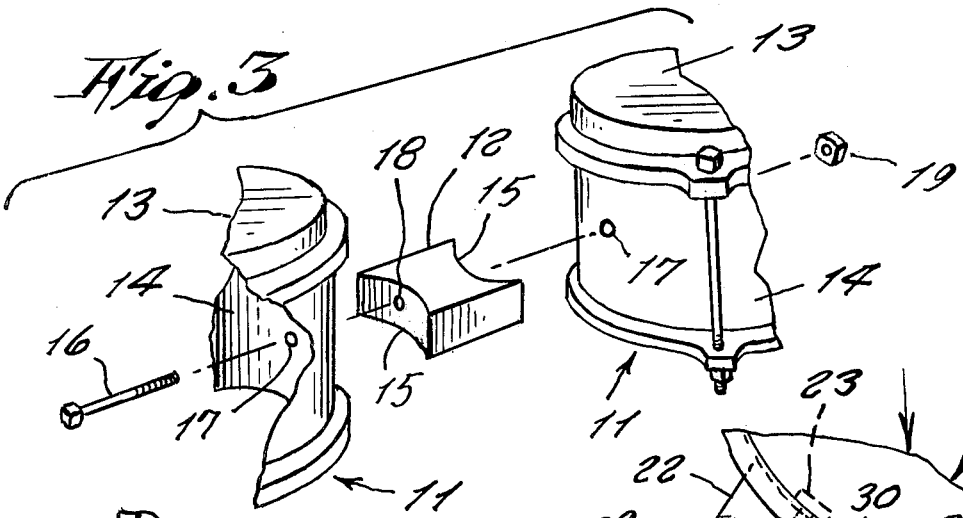
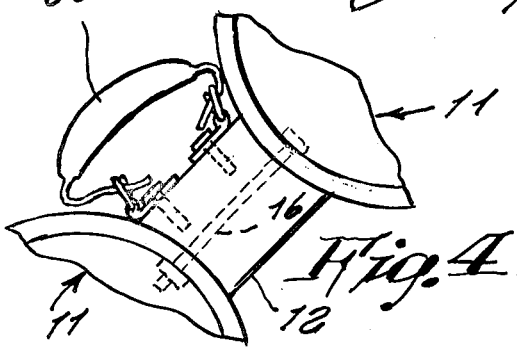
Fig. 4
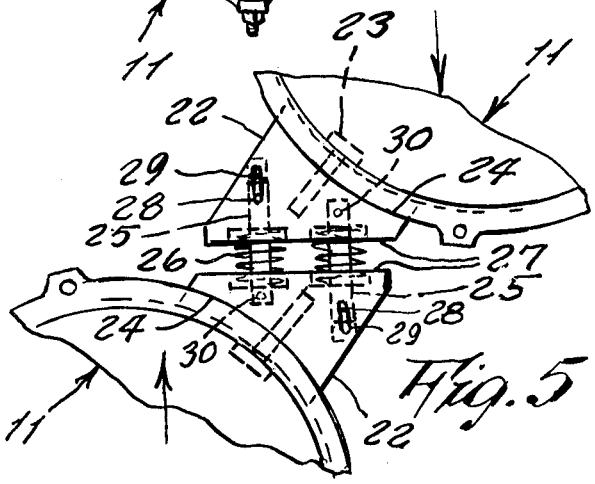
Fig. 5

SEPTACUSSION

This invention relates generally to percussion musical instruments. More specifically, it relates to bongo drum interconnection devices.

It is well known that bongo drum players usually have several separate such drums in front of them, for selectively being beaten during a performance of a musical work. Accordingly, these drums must be supported upon a stand, in order to be stationarily and comfortably located before the player.

A principal object of the present invention is to provide a septacussion assembly, wherein several such drums are firmly fastened together, so as to form a single percussion instrument, and which, when properly tuned, can be made to sound like bongo, congo and osidrums.

Another object is to provide a septacussion percussion instrument, which, when properly played, requires no stand, so that if the performer is an itinerant musician, playing in various places, he does not need, additionally, to transport a stand along with his equipment.

Other objects are to provide a septacussion percussion instrument, which is simple in design, inexpensive to manufacture, rugged in construction, easy to use, and efficient in operation.

These, and other objects, will be readily evident, upon a study of the following specification, and the accompanying drawings, wherein:

FIG. 1 is a front perspective view of the septacussion bongo drums, shown being played;

FIG. 2 is a side edge view thereof;

FIG. 3 is an exploded perspective view of the interconnecting block assembly between the drums;

FIG. 4 is a top view of a block including a carrying handle incorporated therewith;

FIG. 5 is a top view of another design of block assembly, which is longitudinally contractable, so as to allow a player, more easily, to reach the further drums.

Figure 6:
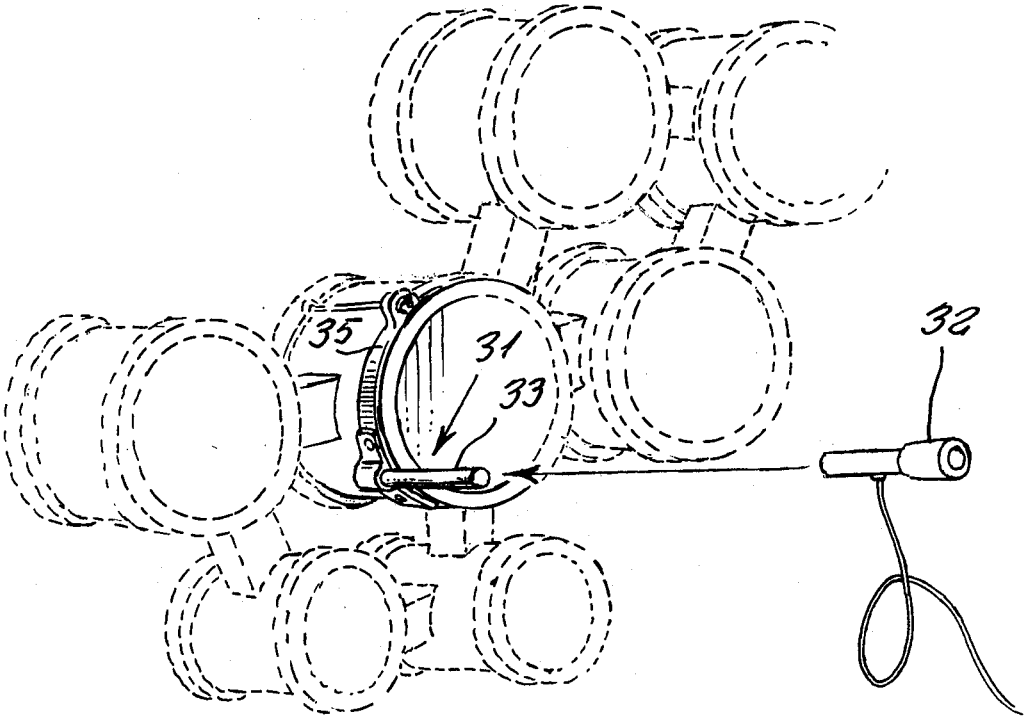
FIG. 6 is a rear perspective view of the septacussion bongo drums, and showing a microphone holder mounted thereon.

Referring now to the drawings in greater detail, and more particularly to FIGS. 1 through 4 thereof, at this time, the reference numeral 10 represents a septacussion percussion instrument, according to the present invention, wherein there are seven drums 11 fastened together as a single unit, by means of interconnecting blocks 12.

The drums may comprise conventional bongo drums or the like, and include a stretched skin or drum head 13 on one end of a hollow sounding body 14.

The blocks each comprise a single member, made of a suitable material, and which has a concaved notch 15 at its opposite two ends, in order to fit the countour of two drum bodies, between which it is secured by means of a long, single bolt 16, extending through a hole 17 in each of the bodies, and through a hole 18 extending through the block. A nut 19 is then fitted on the bolt, so as to hold the components together rigidly. Thus, in this design, all the drum heads are aligned in a single plane.

In operative use, as shown in FIGS. 1 and 2, the septacussion instrument may be rested in an inclined portion in a seated player's lap, while a lower end stands on the floor, so that the performer can lean over the same, so as to tap the drum heads.

A strap handle 20 may be attached to one of the blocks, for the purpose of carrying the septacussion instrument. A carrying case, not shown, may also be provided.

Referring now to FIG. 5, a modified design of the invention is shown, wherein a block assembly 21 is used, instead of the above-described block 12, for forming the septacussion. The assembly includes a half-block 22, attached to each drum body by a screw 23; each half block, accordingly, including one concaved notch 24 for fitting against the body. In the present form of the invention, the two half-blocks are held together by means of two pins 25 therebetween. A tension coil spring 26, around each pin, is located between abutting faces 27 of the two half blocks. Each pin is slidable into one of the half-blocks, when a force is applied against the springs, so as to bring the half-blocks together, such as when a performer tries to reach one of the far drums, thus momentarily contracting the septacussion assembly. A cross pin 28 of the pin slides in a slot 29 of the half-block at such time, while, at its other end, the pin is affixed to a half block by a cross pin 30.

Referring now to FIG. 6, a holder 31 may be attached to one of the drums, so as to support a microphone 32 above the plane of the drum heads. The holder comprises a post 33, receivable in a hollow handle of the microphone, the post being affixed in a bracket 34 mounted on a band 35 of the drum.

While various changes may be made in the detail consruction, it is understood that such changes will be within the spirit and scope of the present invention, as is defined by the appended claims.

What I claim as new, is:

1. A septacussion percussion instrument, comprising, in combination, a plurality of drums and an assembly for holding said drums fixedly together, said assembly comprising a block between adjacent said drums, a carrying handle attached to one said block, and a microphone holder attached to one said drum, and means to contract said septacussion instrument.

2. The combination as set forth in claim 1, wherein said plurality of drums comprise bongo drums.

3. The combination as set forth in claim 2, wherein each said drum comprises a drum head at one end of a hollow body, and all said drum heads are on the same plane.

* * * * *